US006354007B1

(12) United States Patent
Scarla

(10) Patent No.: US 6,354,007 B1
(45) Date of Patent: Mar. 12, 2002

(54) UTILITY KNIFE

(76) Inventor: Robert E. Scarla, 7498 E. Monte Cristo Ave., Suite No. 102, Scottsdale, AZ (US) 85260

( * ) Notice: Subject to any disclaimer, the term of this patent is extended or adjusted under 35 U.S.C. 154(b) by 0 days.

(21) Appl. No.: 09/676,132

(22) Filed: Sep. 29, 2000

(51) Int. Cl.[7] ..... B26B 1/02
(52) U.S. Cl. ..... 30/156; 30/330
(58) Field of Search ..... 30/153, 155, 156, 30/157, 158, 159, 160, 161, 329, 330

(56) References Cited

U.S. PATENT DOCUMENTS

| | | | | |
|---|---|---|---|---|
| 493,075 A | | 3/1893 | Evertz | |
| 515,045 A | | 2/1894 | Von Bultzingslowen | |
| 1,444,324 A | | 2/1923 | Brooks | |
| 1,706,251 A | | 3/1929 | Perry | |
| 2,134,973 A | | 11/1938 | Harwell | |
| 2,265,775 A | * | 12/1941 | McNamara | 30/156 |
| 2,284,128 A | | 5/1942 | Bush | |
| 2,523,575 A | | 9/1950 | Kassel | |
| 2,914,850 A | * | 12/1959 | Kuhnl | 30/156 |
| 3,306,297 A | | 2/1967 | Voorhees et al. | |
| 4,017,969 A | * | 4/1977 | Stonebraker | 30/156 |
| 4,261,104 A | * | 4/1981 | Cuscovitch | 30/330 |
| 4,604,805 A | * | 8/1986 | Krieger et al. | 30/330 |
| 4,936,014 A | * | 6/1990 | Shaanan et al. | 30/162 |
| 5,095,624 A | | 3/1992 | Ennis | |
| 5,909,930 A | | 6/1999 | Ragland, III et al. | |
| 5,966,816 A | | 10/1999 | Robeson | |

* cited by examiner

*Primary Examiner*—Hwei-Siu Payer
(74) *Attorney, Agent, or Firm*—Tod R. Nissle, P.C.

(57) ABSTRACT

A utility knife include a handle, a neck pivotally mounted on the handle, and a blade mounted in the neck. The neck can be folded into the handle to transport the utility knife. The blade is slidably removably inserted into and from the handle without requiring disassembly of the handle.

4 Claims, 3 Drawing Sheets

FIG. 6
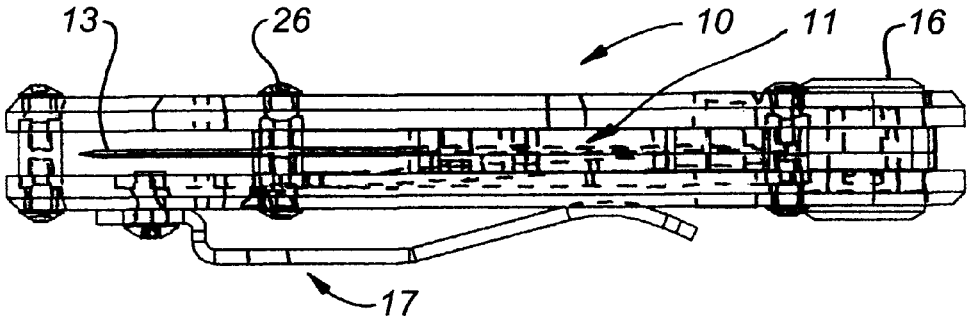
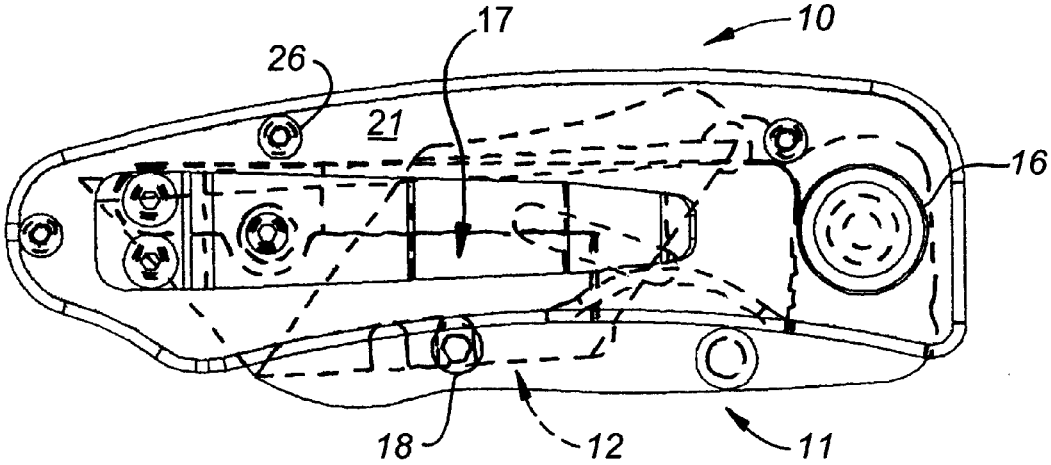
FIG. 7

UTILITY KNIFE

This invention pertains to a utility knife.

More particularly, this invention pertains to a utility knife which utilizes a cutting blade having a trapezoidal shape.

In a further respect, this invention pertains to a method and apparatus which facilitates the safe transport and operation of a utility knife.

Conventional utility knives are well known and include an elongate, typically gray colored handle which is approximately six inches long. A blade is mounted in the knife handle. The blade has a trapezoidal shape. The blade is pushed through a slot formed in the front of the handle. The blade moves between a first stored operative position inside the handle and a second deployed operative position with a portion of the blade outside the handle. A button on the top of the knife handle is slidably pushed along a slot formed in the top of the handle. When the button is pushed to one end of the slot, the trapezoidal blade is in the first stored operative position. When the button is pushed to the other end of the slot, the trapezoidal blade is in the second deployed operative position. When the blade is in the second deployed operative position, the utility knife can be used to cut desired objects with the blade.

One disadvantage of a conventional utility knife is that with use the button becomes loose and the blade can unintentionally slide from its first stored operative position to its second deployed operative position. This can be dangerous, especially when the utility knife is in a person's pocket. Another disadvantage of a conventional utility knife is that the length of the handle makes is awkward to carry the knife in a pants pocket. A further disadvantage of a conventional utility knife is that the entire handle of the knife ordinarily must be disassembled in order to insert a new blade in the utility knife.

Accordingly, it would be highly desirable to provide an improved utility knife and method for using the same which would facilitate the safe transport and use of the knife.

Therefore, it is a principal object of the instant invention to provide an improved utility knife.

A further object of the invention is to provide an improved apparatus and method for using a utility knife which includes a blade having a trapezoidal shape.

Another object of the invention is to provide an improved method and apparatus for securing and removing a trapezoidal blade from a utility knife.

Still a further object of the invention is to provide an improved method and apparatus for utilizing a utility knife which significantly reduces the risk that the utility knife blade can inadvertently slide free and injure a user.

The foregoing and other, further and more specific objects and advantages of the invention will be apparent from the following detailed description of the invention, taken in conjunction with the drawings, in which:

FIG. 6 is a duplication of the depiction of the utility knife of FIG. 2 with dashed lines incorporated to further illustrate construction details of the invention; and, FIG. 7 is a duplication of the depiction of the utility knife of FIG. 3 with dashed lines incorporated to further illustrate construction details thereof.

Figure 1:
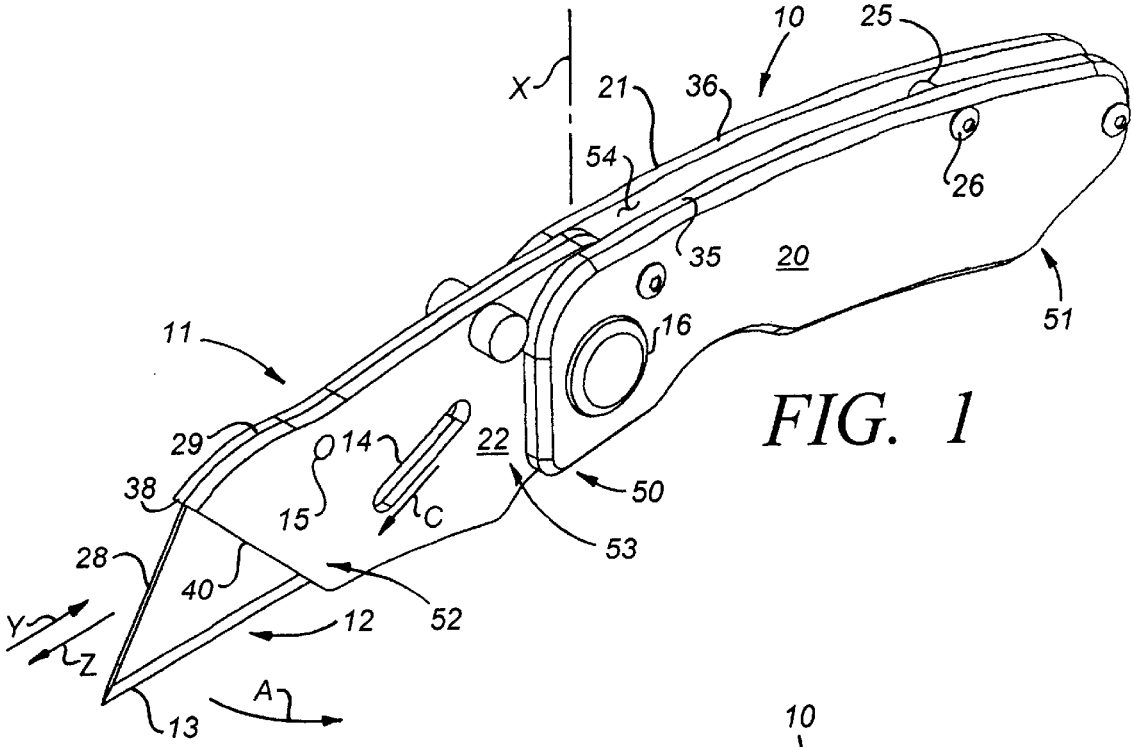
FIG. 1 is perspective view illustrating a utility knife constructed in accordance with the principles of the invention.

Briefly, in accordance with the invention, I provide an improved utility knife. The utility knife includes a handle having a first end, a second end, and an elongate groove; a neck having a distal end and having a proximate end; and, a trapezoidal blade mounted on the distal end. The blade includes a base; an upper edge opposed to and spaced apart from the base; a cutting edge extending along the base; and, an anchor opening formed through the blade. About half of the cutting edge extends into the distal end and about half of the cutting edge extends outwardly from the distal end of the neck. The utility knife also includes a system for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes apparatus extending through the neck and the anchor opening to secure the blade in the neck.

In a further embodiment of the invention, I provide an improved utility knife. The utility knife includes a handle having a first end, a second end, and an elongate groove; a neck having a distal end, a proximate end, and an opening; an aperture formed in the distal end of the neck; and, a trapezoidal blade slidably inserted in the aperture. The blade includes a base; an upper edge opposed to and spaced apart from the base; a cutting edge extending along the base; and, an anchor opening formed through the blade. The blade is moveable between two operative positions with respect to the aperture, a first operative position with the blade slidably removed from the aperture, and a second inserted operative position with the blade slidably inserted in the aperture such that the anchor opening is in registration with the opening in the neck. The utility knife also includes apparatus for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes apparatus extending through the opening in the neck and the anchor opening when the blade is in the second inserted operative position to secure the blade in the neck.

In another embodiment of the invention, I provide an improved utility knife. The knife includes a handle having a first end, a second end, and an elongate groove; a neck having a distal end, a proximate end, and an aperture formed in the distal end of the neck; and, a trapezoidal blade slidably inserted in the aperture and including a base, an upper edge opposed to and spaced apart from the base, a cutting edge extending along the base, and an anchor opening formed through the blade. The blade is moveable between two operative positions with respect to the aperture, a first operative position with the blade slidably removed from the aperture, and a second inserted operative position with the blade slidably inserted in the aperture. The utility knife also includes apparatus for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes apparatus extending through the anchor opening when the blade is in the second inserted operative position to secure said blade in the neck. The utility knife also includes a slot formed in the neck for removing the blade from the aperture.

In still a further embodiment of the invention, I provide a utility knife including a handle having a first end, a second end, and an elongate groove; a neck having a distal end and a proximate end; a trapezoidal blade mounted on the distal end and including a base, an upper edge opposed to and spaced apart from the base, a cutting edge extending along the base, and an anchor opening formed through the blade. The utility knife also includes apparatus for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes securing apparatus extending through the neck and the anchor opening to secure the blade in the neck. The blade, neck, and securing apparatus are shaped and dimensioned such that when the neck is in either of the first and second operative positions, the securing apparatus is inside of the handle.

In yet another embodiment of the invention, I provide an improved method of utilizing a utility knife. The utility knife includes a handle; a neck; and a trapezoidal blade mounted in the handle. The improved method includes the steps of pivotally attaching the neck to the handle such that the neck can be folded between an open and a closed position; pivoting the neck to a closed position; transporting the utility knife to a work location; and, pivoting the neck to an open position.

Figure 5:
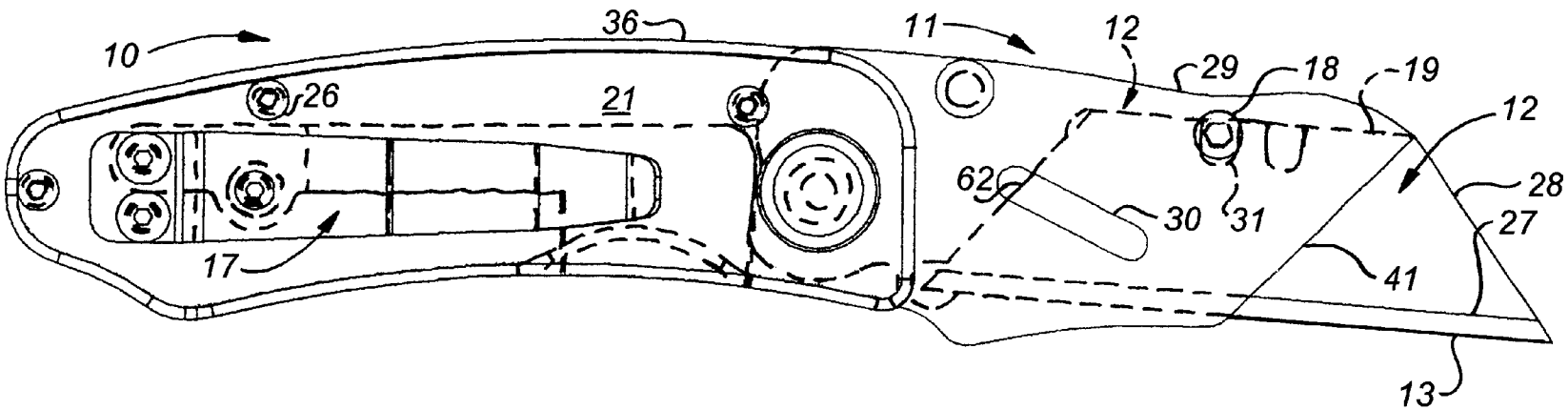
FIG. 5 is a side view of the utility knife of FIG. 4 illustrating additional construction details thereof.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 7 illustrate a utility knife including a handle 10 and neck 11. Handle 10 includes first end 50, second end 51, and groove 54. Neck 11 includes distal end 52, proximate end 53, tip or leading edge 38, and upper edge 29. Opening 15 is formed through neck 11. Opposing, spaced apart, slots 14 (FIG. 1) and 30 (FIG. 5) can be used to assist in removing blade 12 from neck 11 in the direction of arrow Z. Neck 11 includes aperture 39 shaped and dimensioned to slidably receive trapezoidal blade 12 such that an anchor opening 31 formed in blade 12 moves into registration with opening 15. When openings 15, 31 are in registration, bolt/nut 18 is passed through openings 15, 30 to removably fixedly secure blade 12 in aperture 39 and, consequently, in neck 11. Aperture 39 is bounded on one side by edge 40 (FIG. 1) and on the other side by edge 41 (FIG. 5). A pin or other desired fastening means can be used in place of bolt/nut 18.

Trapezoidal blade 12 includes base 27 (FIG. 5), upper edge 19 (FIG. 5), and anchor opening 31. Cutting edge 13 extends along base 27. When blade 12 is mounted in neck 11 in the manner shown in FIGS. 1 to 7, about one-half of cutting edge 13 (i.e., 40% to 60% of the length of edge 13) extends outwardly away from aperture 39 and neck 11 and can be utilized to cut an object. The other half of edge 13 is housed in aperture 39 in neck 11 such that the other half of edge 13 cannot be utilized for cutting. The proportion of blade 12 housed in neck 11 and unavailable for cutting can vary as desired.

The proximate end 53 of neck 11 is pivotally attached to the first end 50 of handle 10 by pin apparatus 16 or by any other desired fastening apparatus which permits neck 11 to pivot with respect to handle 10.

Handle 10 includes sides 20 and 21. Side 20 includes upper edge 35. Side 21 includes upper edge 36. Clip 17 (FIGS. 2 and 3) is attached to side 21. Clip 17 permits the utility knife of the invention to be secured to a shirt pocket, belt, etc. Sides 20 and 21 are secured together by a plurality of bolts which each pass through an aperture in side 20 or 21 and thread into internally threaded hollow spacers. For example, in FIGS. 1 to 3, externally threaded bolts 26 thread into hollow, internally threaded spacer 25.

In use, neck 11 is pivotally attached to handle 10 with pin apparatus 16. Bolt/nut 18 is removed from opening 15. Trapezoidal blade 12 is slidably inserted in aperture 39 in the direction of arrow Y in FIG. 1 until opening 15 is in registration with opening 31. Aperture 39 and blade 12 are preferably, but not necessarily, shaped and dimensioned such that when blade 12 seats in aperture 39, openings 15 and 31 are in alignment. Bolt/nut 18 is inserted through aligned openings 15, 31 to removably fixedly secure blade 12 in aperture 39 and neck 11. Neck 11 is pivoted in the direction of arrow A to the folded operative position illustrated in FIGS. 2, 3, 6, 7. In the folded position, edge 13 is housed in groove 54. Groove 54 extends between sides 20 and 21 of handle 10. Spring 60 functions in the manner of a spring found in conventional pocket knives and functions to maintain neck 11 either in the folded position of FIGS. 2 and 3 or in the open or deployed operative position of FIGS. 1, 4, and 5.

Figure 2:
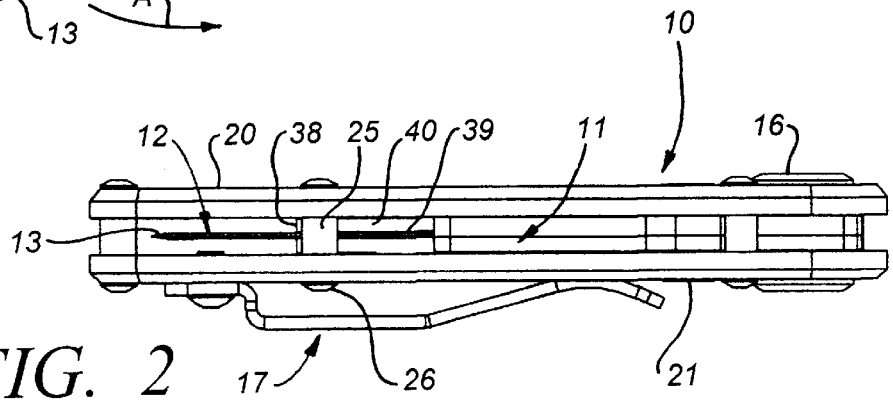
FIG. 2 is a bottom view of the utility knife of FIG. 1 illustrating the knife after the neck has been pivoted from the open position of FIG. 1 to a closed position.
Figure 3:
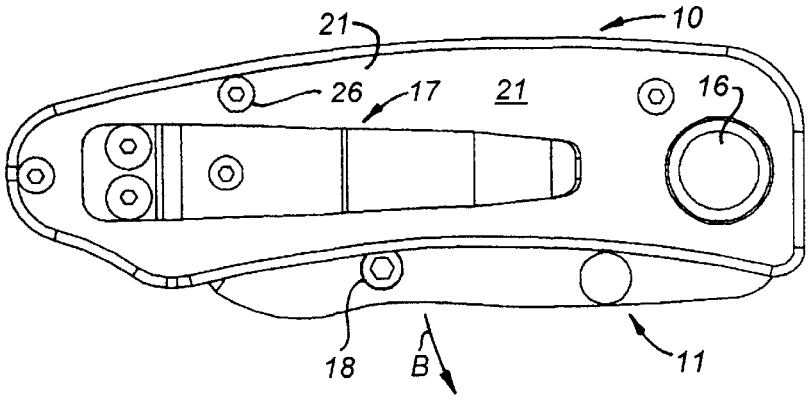
FIG. 3 is a side view of the utility knife of FIG. 2 illustrating further construction details thereof.
Figure 4:
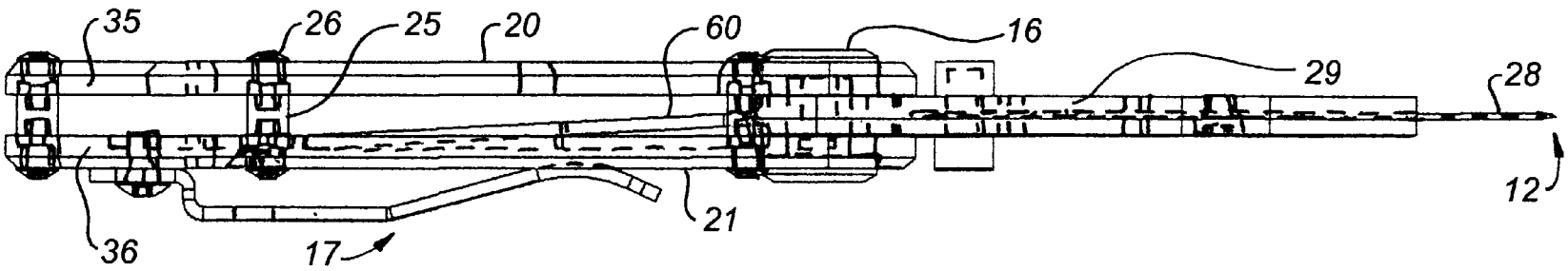
FIG. 4 is a top view of the utility knife of FIG. 1 illustrating the knife after it has been rotated about 180 degrees about axis X.

After the utility knife is in the folded position of FIG. 2, it is transported to a desired location at which the portion of neck 11 extending outwardly from handle 10 in FIG. 3 is grasped between the fingers of one hand and pulled outwardly in the direction of arrow B and pulled to the open operative position illustrated in FIG. 1. The handle 10 is then grasped, and the utility knife can be manipulated such that edge 13 cuts a desired object. In the event it is desired to remove blade 12, nut/bolt assembly 18 is removed and the nose of a screwdriver or other object is inserted into slot(s) 14, 30 against edge 62 (FIG. 5) of blade 12. The nose of the screwdriver is pushed or pulled in the direction of arrow C along slot(s) 14, 30 to push blade 12 out of aperture 39. A new blade 12 is inserted in the manner earlier described, or, the old blade is turned 180 degrees to expose the unused portion of edge 13 and is reinserted in aperture 39. Assembly 18 can be positioned inside or outside of groove 54 when neck 11 is in the closed position of FIG. 3.

Blade 12 includes leading edge 28. Neck 11 includes face 22. Axis X extends through pin apparatus 16.

Having described my invention in such terms as to enable those of skill in the art to make and practice it, and having described the presently preferred embodiments thereof, I claim:

1. A utility knife including (a) a handle having a first end, a second end, and an elongate groove;

(b) a neck having a distal end and having a proximate end;

(c) a trapezoidal blade mounted on said distal end, said blade including (i) a base, (ii) an upper edge opposed to and spaced apart from said base, (iii) a cutting edge extending along said base, and (iv) an anchor opening formed through said blade, about half of said cutting edge extending into said distal end and about half of said cutting edge extending outwardly from said distal end of said neck;

(d) means for pivotally attaching said proximate end to said first end such that said neck can be moved between two positions,
(i) a first open unfolded operative position with said cutting edge exposed for use to cut an object, and
(ii) a second closed folded position with said cutting edge positioned in said groove; and, (e) means extending through said neck and said anchor opening to secure said blade in said neck.

2. A utility knife including (a) a handle having a first end, a second end, and an elongate groove;

(b) a neck having
(i) a distal end,
(ii) a proximate end, and
(iii) an opening;

(c) an aperture formed in said distal end of said neck;

(d) a trapezoidal blade slidably inserted in said aperture, said blade including
(i) a base,
(ii) an upper edge opposed to and spaced apart from said base,
(iii) a cutting edge extending along said base, and
(iv) an anchor opening formed through said blade,
said blade moveable between two positions with respect to said aperture,
(v) a first position with said blade slidably removed from said aperture, and
(vi) a second inserted operative position with said blade slidably inserted in said aperture such that said anchor opening is in registration with said opening in said neck;

(e) means for pivotally attaching said proximate end to said first end such that said neck can be moved between two positions,
(i) a first open unfolded operative position with said cutting edge exposed for use to cut an object, and
(ii) a second closed folded position with said cutting edge positioned in said groove; and, (f) means extending through said opening in said neck and said anchor opening when said blade in said second inserted operative position to secure said blade in said neck.

3. A utility knife including (a) a handle having a first end, a second end, and an elongate groove;

(b) a neck having
(i) a distal end,
(ii) a proximate end;

(c) an aperture formed in said distal end of said neck;

(d) a trapezoidal blade slidably inserted in said aperture, said blade including (i) a base,
(ii) an upper edge opposed to and spaced apart from said base,
(iii) a cutting edge extending along said base, and
(iv) an anchor opening formed through said blade,
said blade moveable between two positions with respect to said aperture,
(v) a first position with said blade slidably removed from said aperture, and
(vi) a second inserted operative position with said blade slidably inserted in said aperture;

(e) means for pivotally attaching said proximate end to said first end such that said neck can be moved between two positions,
(i) a first open unfolded position with said cutting edge exposed for use to cut an object, and
(ii) a second closed folded position with said cutting edge positioned in said groove;

(f) means extending through said anchor opening when said blade in said second inserted operative position to secure said blade in said neck; and, (g) a slot formed in said neck for removing said blade from said aperture.

4. A utility knife including (a) a handle having a first end, a second end, and an elongate groove;

(b) a neck having a distal end and having a proximate end;

(c) a trapezoidal blade mounted on said distal end, said blade including
(i) a base,
(ii) an upper edge opposed to and spaced apart from said base,
(iii) a cutting edge extending along said base, and
(iv) an anchor opening formed through said blade;

(d) means for pivotally attaching said proximate end to said first end such that said neck can be moved between two positions,
(i) a first open unfolded operative position with said cutting edge exposed for use to cut an object, and
(ii) a second closed folded position with said cutting edge positioned in said groove; and, (e) securing means extending through said neck and said anchor opening to secure said blade in said neck;

said blade, said neck, and said securing means being shaped and dimensioned such that when said neck is in said second position, said securing means is inside of said handle.

* * * * *